United States Patent [19]

Bächler et al.

[11] Patent Number: 4,479,360

[45] Date of Patent: Oct. 30, 1984

[54] CRYOPUMP

[75] Inventors: Werner Bächler, Rosrath - Hoffnungsthal; Rolf Heisig, Weilerswist, both of Fed. Rep. of Germany

[73] Assignee: Leybold-Heraeus GmbH, Cologne, Fed. Rep. of Germany

[21] Appl. No.: 447,353

[22] Filed: Dec. 6, 1982

[30] Foreign Application Priority Data

Aug. 31, 1982 [DE] Fed. Rep. of Germany ..... 3232324

[51] Int. Cl.[3] ..... B01D 8/00

[52] U.S. Cl. ..... 62/55.5; 55/269; 62/268; 417/901

[58] Field of Search ..... 62/55.5, 268; 55/269; 417/901

[56] References Cited

U.S. PATENT DOCUMENTS

| | | | |
|---|---|---|---|
| 4,240,262 | 12/1980 | Nakamura et al. | 62/55.5 |
| 4,295,338 | 10/1981 | Welch | 62/55.5 |
| 4,311,018 | 1/1982 | Welch | 62/55.5 |
| 4,336,690 | 6/1982 | Welch | 62/55.5 |

*Primary Examiner*—Ronald C. Capossela

*Attorney, Agent, or Firm*—Felfe & Lynch

[57] ABSTRACT

A cryopump having two refrigerator stages operable for producing progressively lower temperatures and at least one surface between the refrigerator stages and in such thermal communication therewith as to have, during operation of the refrigerator stages, temperatures which adsorb and desorb thereon at least one gas in the cryopump, having the improvement comprising:

shield means extending over substantially all of the surface for substantially preventing the gas from circulating to the surface; and means for maintaining the shield means at a substantially constant temperature during operation of the refrigerator stages.

8 Claims, 2 Drawing Figures

CRYOPUMP

BACKGROUND OF THE INVENTION

The invention relates to a cryopump, or cryogenic pump, having surfaces exposed to the gases to be pumped, some of these surfaces being intended for the adsorption of the gases while others are not.

Refrigerator-operated cryopumps are known from German patent publication DOS No. 26 20 880, 28 21 276 and 30 38 415. They comprise three surfaces intended for adsorption of the various types of gases. The first surface is in good thermal contact with the first stage of the refrigerator and has a substantially constant temperature between 60 and 100 K, depending on the type and output of the refrigerator, with a low temperature gradient. A metal having appropriate heat-conductivity properties is selected as material of construction. These surfaces, which may include the surface of a baffle that protects the lower-temperature pump surfaces from incident heat radiation, serve mainly for the deposition of water vapor and carbon dioxide by cryocondensation. Cryocondensation occurs when gases impinge on a precoated homogeneous surface and condense to the liquid or solid phase. The binding forces are of physical nature, and the binding energy corresponds to the heat of vaporization.

The second surface is in thermal contact with the second stage of the refrigerator. It is likewise a metal surface and is intended for the removal, by cryocondensation and cryotrapping, of hydrogen, argon, carbon monoxide, methane and halogenated hydrocarbons, for example. Cryotrapping designates the process in which lower-boiling and therefore more difficulty condensable gases impinge on a precoated surface simultaneously with more readily condensable gases, the more difficulty condensable gases being incorporated in the steadily growing condensate film of the more readily condensable gases.

The third surface is also at the temperature of the second stage of the refrigerator (or at a correspondingly lower temperature in the case of a three-stage refrigerator) and is covered with an adsorbent (activated carbon or the like). It is essentially on this surface that the cryosorption of lighter gases such as hydrogen, helium and neon is to take place. Cryosorption occurs when gases impinge on an uncoated, heterogeneous surface and are bound by unsaturated residual valences of the interfacial atoms of the surface. These surfaces are arranged in such a way that they can be reached by the light gases only by "detours". The heavier gases are practically unable to diffuse into spaces with cryosorption surfaces which can be reached only by a circuitous route. They will condense on the readily reachable cryocondensation surfaces. Premature contamination of the adsorbent with heavy gases is thus prevented. The pumping activity for light gases is preserved for a longer period of time.

In addition to these surfaces serving for the adsorption of the gases to be pumped, prior-art cryopumps comprise surfaces which are not intended to adsorb gases. These are the exteriors of the cylindrical tubes in which the displacers of the refrigerators move and which extend from the foot of the pump to the first stage of the refrigerator and between the first and second stages.

In tests conducted with cryopumps of the type described, and also in using such pumps in sputtering systems, the problem has been encountered time and again that the pumping times of these pumps are unduly long, that is to say, the pumps take a relatively long time to attain the desired low pressures, particularly when the pressure in the pump during a sputtering operation momentarily rises to a relatively high absolute-pressure level (e.g., $1\times10^{-2}$ millibars). Moreover, pressure fluctuations would occur during operation for which there was no explanation at first. The object of the invention thus was to eliminate these problems. This object could be accomplished only after the inventors had come to the following conclusions concerning the cause of the described problems:

With prior-art cryopumps, it is unavoidable, especially after an extended period of operation, that gases should condense also on surfaces which are not intended to adsorb gases. Because of the temperature gradient, there are surfaces in these pumps which are at such intermediate temperatures that gases having specific physical properties (argon, for example) are adsorbed at elevated pressures and then are desorbed as the pressure drops. This may happen to such a degree that the slowly desorbing gases will have a pressure-determining effect, that is to say, will prevent the desired pressure reduction, for a relatively long time.

Moreover, it has been found that temperature variations occur on these surfaces which are tied to the cycle of motion of the displacer that moves periodically therein. Especially in the case of gas mixtures adsorbed by cryocondensation or cryotrapping, these temperature variations give rise to local desorptions, adsorptions and rearrangements of gases which cause undesired pressure fluctuations in the vacuum space.

SUMMARY OF THE INVENTION

On the basis of these findings, it is proposed, with a view to accomplishing the object of the invention, that a shield of substantially constant temperature be associated with surfaces which are not intended to adsorb gases. Since the phenomena described above which interfere with the vacuum in the pressure container manifest themselves particularly on the outside of the cylindrical tube between the first and second stages of the refrigerator, it is advisable to shield this area with a shell constructed either as a tube or of two semicylinders. This shell should be mounted on the first or second stage of the refrigerator in a manner assuring good heat conduction. The other end should be spaced somewhat from the stage located there. The size of the spacing should be such that on the one hand there is no thermal contact and on the other hand the passage of gases is substantially prevented. These requirements are met when the spacing is on the order of one or more millimeters. In a cryopump so constructed, there will be no surfaces with critical transition temperatures or with temperature variations, and the adverse effects which they would have on the pressure developed in the pump thus are practically eliminated.

DESCRIPTION OF THE DRAWINGS

Further advantages and details of the invention will now be described with reference to the embodiments illustrated in the drawings in which.

DETAILED DESCRIPTION OF THE INVENTION

Figure 1:
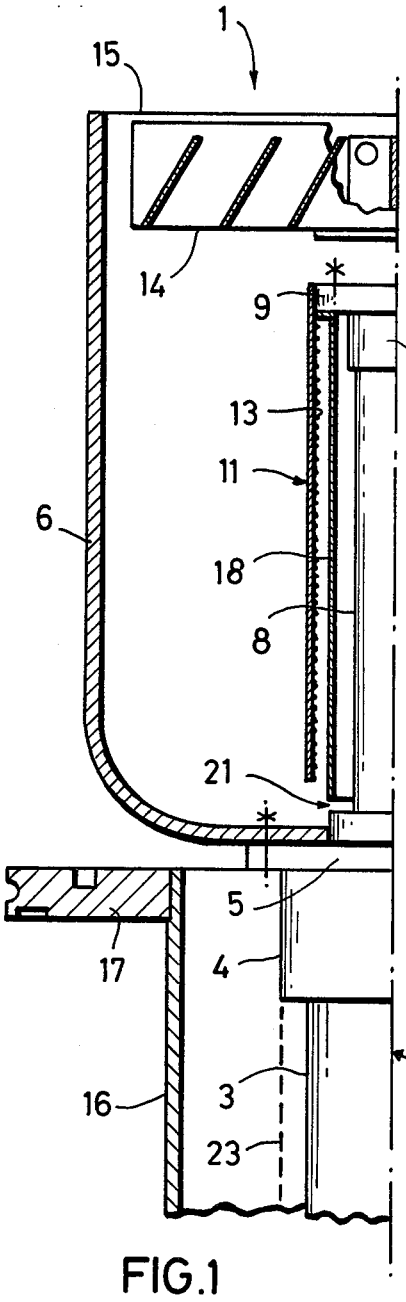
FIG. 1 is a partial elevation, partly in section, of a first embodiment.

Each of these figures shows one half of a substantially axisymmetric cryopump 1 operated by a two-stage refrigerator 2. The latter comprises a cylindrical section 3 between the foot (not shown) of the pump and the first stage 4, which has a temperature ranging from 60° to 100° K while the refrigerator is in operation. Mounted on the flange 5 of the first stage 4 in a manner assuring good thermal contact therewith is a metal shield housing 6 which thus assumes the temperature of the first stage 4. The second stage 7 of the refrigerator 2 is disposed inside the housing 6. A cylindrical tube 8 extends between the first stage 4 and the second stage 7 of the refrigerator 2. Disposed inside the tube sections 3 and 8 are the displacers (not shown) of the two stages, which execute periodic motions while the refrigerator is in operation.

Mounted on the flange 9 of the second stage 7, which assumes a constant temperature between 10° and 20° K, are two sheet pump surfaces 11 and 12 in a manner assuring good heat conduction. Said surfaces are covered on their insides with an adsorbent (activated carbon, zeolite, etc.) 13.

The housing 6 shields the second-stage components disposed therein from thermal radiation. This is also the purpose of a baffle 14 which is disposed in the entrance 15 of the housing 6 and is held therein by heat-conducting bridges in such a way that it substantially assumes the temperature of the housing 6.

The pump casing and a mounting flange are designated 16 and 17, respectively. In other embodiments, the casing 16 extends as far as the level of the entrance 15 of the housing 6 so that the mounting flange 7 is also at that level.

The baffle 14 and the interior of the housing 6 form the pump surfaces where water vapor and carbon dioxide are preferentially adsorbed. The outer regions of the pump surfaces 11 are intended to bind primarily gas mixtures through cryocondensation and cryotrapping. The inner pump surfaces, covered with activated carbon or the like, serve essentially for the cryosorption of light gases.

Figure 2:
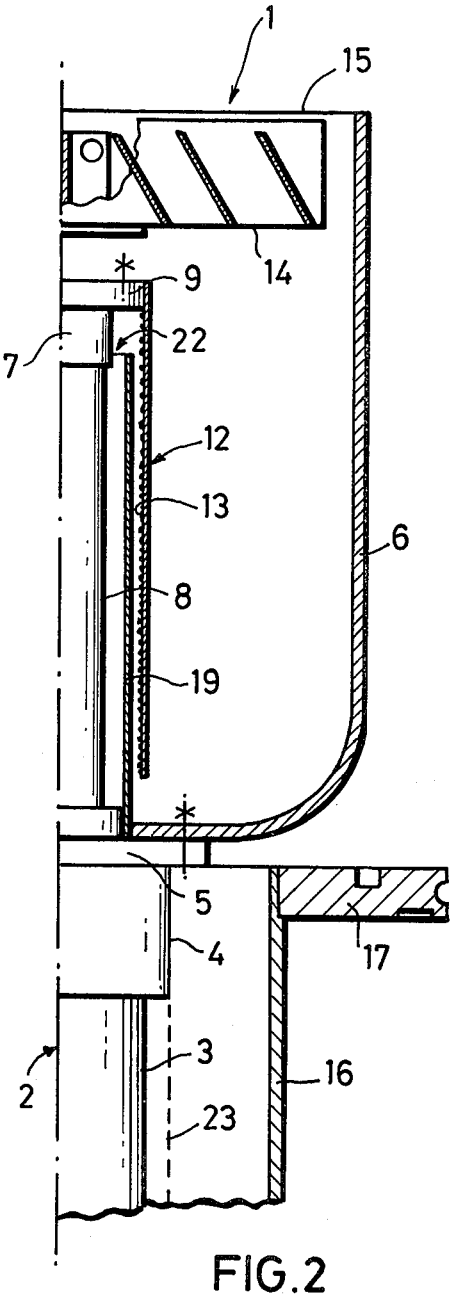
FIG. 2 is a partial elevation, partly in section, of a second embodiment.

Since heavier gases may gradually diffuse also into the space between the tube section 8 and the pump surfaces 11 and 12, particularly when individual types of gases are present in high concentration, it is possible that the phenomena described earlier, namely, adsorption at elevated temperatures, desorption at low temperatures, or undesired rearrangements, may manifest themselves at that point since the tube section 8 is subject not only to the temperature variations described but also to the temperatures of the first stage 4 and the second stage 7 of the refrigerator 2. These phenomena can be suppressed by the use of shielding shells 18 and 19. Shielding shell 18 in FIG. 1 is joined to the flange 9 of the second stage 7 in a manner assuring good heat conduction and extends as far as directly above the first stage 4 of the refrigerator 2. The spacing 21 between it and that stage must be such that on the one hand there is no thermal contact between them while on the other hand the penetration of gas particles is substantially prevented. The shell 18 thus assumes over its entire length the temperature of the second stage 7 so that there are no intermediate-temperature regions or temperature variations. In the embodiment of FIG. 2, the shell 19 is connected to the first stage 4 of the refrigerator 2 in a manner assuring good heat conduction and assumes its temperature since it is at a spacing 22 from the second stage 7. In this embodiment, too, the gases to be pumped will encounter no surfaces having undesired intermediate temperatures.

The invention has been described with reference to a cryopump 1 operated with a two-stage refrigerator. In this case, too, the cylindrical tube section 3 may be provided with a shielding shell 23 (indicated by dashed lines). Such a shield may be useful also in a cryopump operated with a single-stage refrigerator. Cryopumps are further known which are operated with three-stage refrigerators. In such a case, it will be advantageous to provide at least the refrigerator sections extending between the first and second stages and between the second and third stages with the shields in accordance with the invention.

The shields may take many forms. They may be in the form of a shell or consist of two semicylinders. They need not have a cylindrical cross section. The material of construction should be one which has good heat conductivity at the temperatures to which it will be exposed so that there will be no undesired temperature gradients.

The above embodiments and others having variations or modifications of the features thereof as may occur to those skilled in the art are comtemplated as within the scope of the following claims.

What is claimed is:

1. In a cryopump having two refrigerator stages operable for producing progressively lower temperatures and at least one surface between the refrigerator stages and in such thermal communication therewith as to have, during operation of the refrigerator stages, temperatures which adsorb and desorb thereon at least one gas in the cryopump, the improvement comprising:

shield means extending over substantially all of the surface for substantially preventing the gas from circulating to the surface; and means for maintaining the shield means at a substantially constant temperature during operation of the refrigerator stages.

2. A cryopump as in claim 1, wherein at least one of the refrigerator stages has a portion having a substantially constant temperature during operation thereof, and wherein the means for maintaining the shield means at a substantially constant temperature comprises forming the shield means form a material of good heat conductivity at the temperature of the portion of the one refrigerator stage and means for mounting the shield means in thermal communication only with the portion thereof.

3. A cryopump as in claim 1, wherein the shield means is a shell enclosing the surface.

4. A cryopump as in claim 3, wherein the surface and shell are cylindrical.

5. A cryopump as in claim 4, wherein the shell is sectioned.

6. In a cryopump having refrigerator means operable for producing low temperatures and having a portion having a substantially constant temperature and at least one surface having temperatures which adsorb and desorb thereon at least one gas in the cryopump during operation of the refrigerator means, the improvement comprising:

a shield of a material having good heat conduction at the temperature of the portion of the refrigerator means, in thermal and supportive communication only with the portion of the refrigerator means, spacedly extending over substantially all of the surface, and spaced from other portions of the refrigerator means sufficiently to be thermally insulated therefrom and so as substantially to prevent the gas from circulating to the surface.

7. A cryopump as in claim 6, wherein the refrigerator means has successive refrigerator stages and the surface is between two stages thereof.

8. In a cryopump having refrigerator means operable for producing low temperatures and having a portion having a substantially constant temperature during operation thereof, at least one first surface operable thereby for the adsorption of at least one gas from the cryopump, and at least one second surface which is not intended for gas adsorption, the second surface which is not intended for gas absorption being in such thermal communication with the refrigerator means as to have temperatures which would adsorb and desorb at least one gas from the cryopump thereon during operation of the refrigerator means, the improvement comprising:

a shield of a material having good heat conduction at the temperature of the portion of the refrigerator means, in thermal and supportive communication only with the portion of the refrigerator means, spacedly extending over substantially all of the second surface, and spaced from other portions of the refrigerator means sufficiently to be thermally insulated therefrom and so as substantially to prevent the gas from circulating to the second surface.

* * * * *